US005533339A

United States Patent [19]

Clare et al.

[11] Patent Number: 5,533,339

[45] Date of Patent: Jul. 9, 1996

[54] AIR SEPARATION

[75] Inventors: Stephen R. Clare, Bognor Regis; Paul Higginbotham, Guildford; David M. Stuart, Thornton Hill, all of United Kingdom

[73] Assignee: The BOC Group plc, Windlesham Surrey, England

[21] Appl. No.: 445,632

[22] Filed: May 22, 1995

[30] Foreign Application Priority Data

May 27, 1994 [GB] United Kingdom ..... 9410686

[51] Int. Cl.[6] ..... F25J 3/04

[52] U.S. Cl. ..... 62/654; 62/924

[58] Field of Search ..... 62/22, 24, 39, 62/41

[56] References Cited

U.S. PATENT DOCUMENTS

| | | | |
|---|---|---|---|
| 5,197,296 | 3/1993 | Prosser et al. | 62/22 |
| 5,265,429 | 11/1993 | Dray | 62/41 |
| 5,440,884 | 8/1995 | Bonaquist et al. | 62/22 |

FOREIGN PATENT DOCUMENTS

| | | |
|---|---|---|
| 0580348 | 1/1994 | European Pat. Off. . |
| 0580345 | 1/1994 | European Pat. Off. . |
| 4303771 | 8/1994 | Germany . |

*Primary Examiner*—Ronald C. Capossela
*Attorney, Agent, or Firm*—David M. Rosenblum; Larry R. Cassett

[57] ABSTRACT

Air is compressed in compressors, cooled in a main heat exchanger, and separated into oxygen and nitrogen products in a double rectification column comprising a higher pressure rectification column and a lower pressure rectification column. A liquid oxygen product is withdrawn from the lower pressure column via a conduit. A liquid nitrogen product is also formed. An argon-enriched oxygen vapour stream is withdrawn from the lower pressure column through an outlet and has argon separated from it in an argon column. In order to help meet the requirements of the higher pressure column for reflux, a nitrogen vapour stream is withdrawn from the top of the lower pressure column, is warmed by passage through the heat exchanger, is recompressed in a compressor, and is liquefied by passage back through the heat exchanger from its warm end to its cold end and passage through a valve. A high liquid make and a high argon recovery can both be achieved.

9 Claims, 1 Drawing Sheet

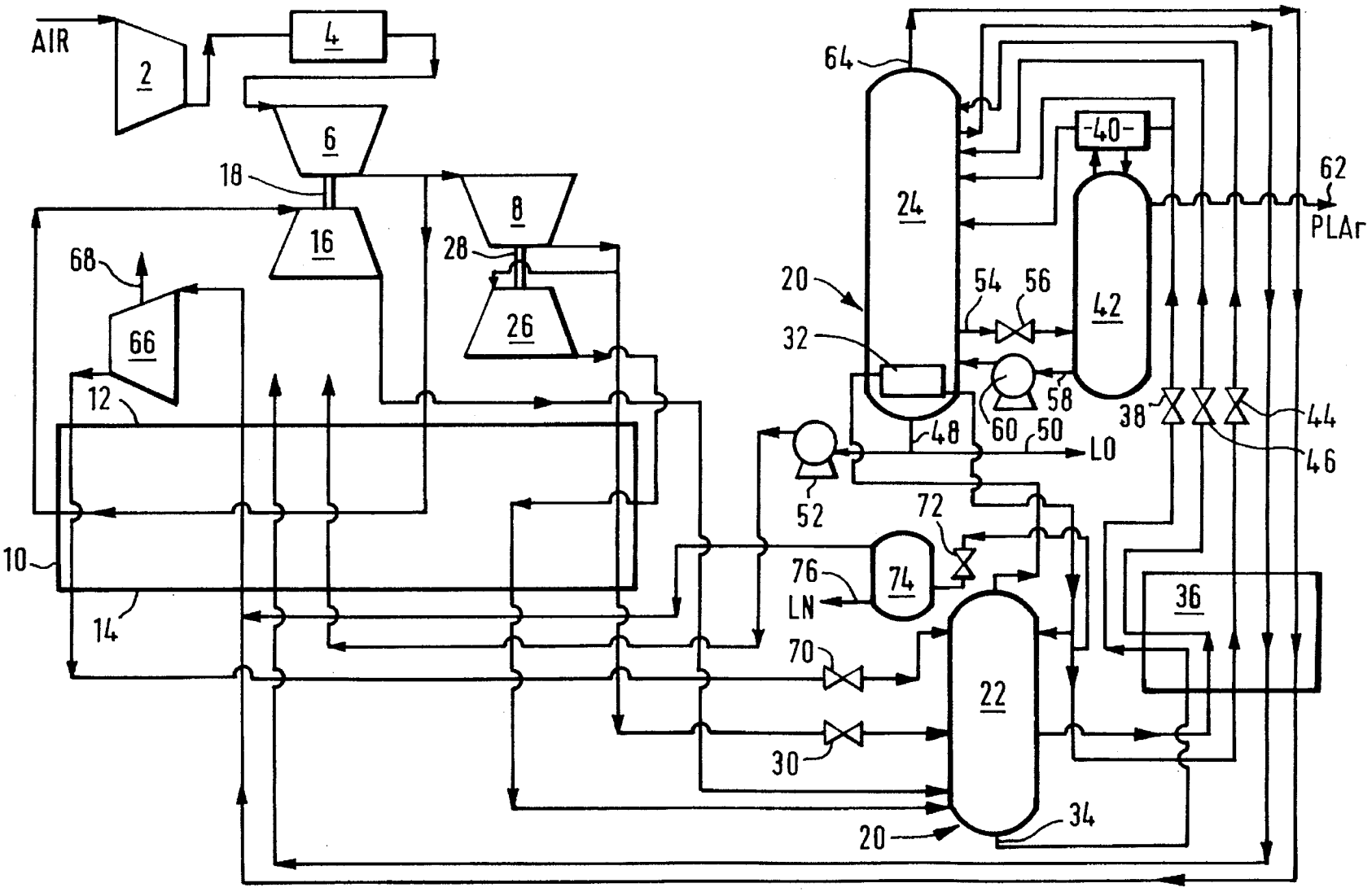
AIR
PLAr
LO
LN
-40-
2
4
6
8
10
12
14
16
18
20
22
24
26
28
30
32
34
36
38
42
44
46
48
50
52
54
56
58
60
62
64
66
68
70
72
74
76

AIR SEPARATION

BACKGROUND OF THE INVENTION

This invention relates to a method and plant for separating air.

The most important method commercially for separating air is by rectification. In typical air rectification processes there are performed the steps of compressing a stream of air, purifying the resulting stream of compressed air by removing water vapour and carbon dioxide from it, precooling the stream of compressed air by heat exchange with returning product streams to a temperature suitable for its rectification. The rectification is performed in a so-called "double rectification column" comprising a higher pressure column and a lower pressure column, i.e. one of the two columns operates at a higher pressure than the other. Most of the incoming air is introduced into the higher pressure column and is separated into oxygen-enriched liquid air and a nitrogen vapour. The nitrogen vapour is condensed. Part of the condensate is used as liquid reflux in the higher pressure column. Oxygen-enriched liquid is withdrawn from the bottom of the higher pressure column and is used to form a feed stream to the lower pressure column. Typically, the oxygen-enriched liquid stream is sub-cooled and introduced into an intermediate region of the lower pressure column through a throttling or pressure reduction valve. The oxygen-enriched liquid air is separated into substantially pure oxygen and nitrogen in the lower pressure column. Gaseous oxygen and nitrogen products are taken from the lower pressure column and typically form the returning streams against which the incoming air is heat exchanged. Liquid reflux for the lower pressure column is provided by taking the remainder of the condensate from the higher pressure column, sub-cooling it, and passing it into the top of the lower pressure column through a throttling valve. An upward flow of vapour through the lower pressure column from its bottom is created by reboiling liquid oxygen. The reboiling is carried out by heat exchanging the liquid oxygen at the bottom of the lower pressure column with nitrogen from the higher pressure column. As a result, the condensed nitrogen vapour is formed.

A local maximum concentration of argon is created at an intermediate level of the lower pressure column beneath that at which the oxygen-enriched liquid air is introduced. If it is desired to produce an argon product, a stream of argon-enriched oxygen vapour is taken from a vicinity of the lower pressure column where the argon concentration is typically in the range of 5 to 15% by volume of argon, and is introduced into a bottom region of a side column in which an argon product is separated therefrom. Reflux for the argon column is provided by a condenser at the head of the column. The condenser is cooled by at least part of the oxygen-enriched liquid air upstream of the introduction of such liquid air into the lower pressure column.

In such a process the oxygen and nitrogen products are typically taken in gaseous state. It is however frequently required to take a proportion of the oxygen and nitrogen products in liquid state. One example is the process described in EP-A-0 576 3 14A. The rate of providing refrigeration for the process may readily be set so as to meet any requirements for providing liquid products. However, the mere provision of refrigeration work in order to meet that work required to liquefy the products does not ensure of itself a satisfactory process. In particular, there is a problem that the greater the proportion of oxygen and nitrogen produced in liquid state as products, the more the upper sections of the lower pressure rectification columns tend to be starved of reflux with the result that the concentration of the argon in the argon-enriched oxygen feed to the argon rectification column falls and the yield of argon drops. In practice, these considerations have the consequence that there is a practical ceiling placed on the proportion of the products of the air separation plant that can be taken in liquid state. It is an aim of the present invention to provide a method and plant which enable this limit to be raised.

SUMMARY OF THE INVENTION

According to the present invention there is provided a method of separating air comprising compressing and purifying the air, fractionating a first stream of the compressed purified air in the higher pressure column of a double rectification column comprising a higher pressure column and a lower pressure column, condensing, by indirect heat exchange with oxygen-rich fluid separated in the lower pressure column, nitrogen vapour separated in the higher pressure column and employing a first stream of the resulting condensate as reflux in the higher pressure column and a second stream of the resulting condensate as reflux in the lower pressure rectification column, withdrawing a proportion of oxygen and/or nitrogen-rich products from the double rectification column in liquid state, separating in an argon column a stream of argon-enriched fluid withdrawn from the lower pressure column so as to obtain argon-rich vapour, condensing at least some of the said argon-rich vapour and employing at least some of the resulting argon-rich condensate in the argon column as reflux, and withdrawing an argon-rich product stream from the argon column, characterised in that liquid nitrogen is formed by warming by indirect heat exchange a stream of nitrogen withdrawn from the double rectification column, compressing said warmed stream of nitrogen, cooling by indirect heat exchange the compressed stream of nitrogen, and reducing the pressure of the cooled, compressed stream of nitrogen.

The invention also provides an air separation plant comprising a double rectification column comprising a higher pressure column for separating nitrogen from a first stream of compressed, purified air, and a lower pressure column; a condenser-reboiler for condensing by indirect heat exchange with oxygen-rich fluid separated in the lower pressure column, nitrogen vapour separated in the higher pressure column, said condenser-reboiler having condensing passages with outlets communicating with both the higher pressure and lower pressure columns so as to enable liquid nitrogen reflux to be supplied in use to both the higher and lower pressure columns; product outlets from the double rectification column for oxygen-rich and nitrogen-rich products, the outlets being arranged such that a proportion of said products are able to be taken in liquid state; an argon outlet from the lower pressure rectification column for argon-enriched oxygen communicating with an argon column for separating argon-rich vapour therefrom; a condenser associated with the argon column for condensing at least some of the said argon-rich vapour and for returning some of the resulting argon-rich condensate to the argon column; and an argon-rich vapour outlet from the argon column for argon-rich vapour, characterised in that the air separation plant additionally includes means for producing liquid nitrogen comprising a heat exchanger for warming a stream of nitrogen withdrawn from the double rectification column, a compressor for compressing the warmed nitrogen stream, a heat exchanger for cooling the stream of compressed nitrogen, and means for reducing the pressure of the cooled, compressed stream of nitrogen.

The method and plant according to the invention enable good argon yields to be achieved even when the "liquid make" is high. By the term "liquid make" is meant the ratio of the rate of production of liquid products to the rate of production of oxygen (including liquid oxygen). A liquid make of about 30% or above is considered high in the art. The method according to the present invention enables the argon yield to be maintained above about 90% at liquid makes in the range of about 30% to about 70%.

Preferably, all the air to be separated is compressed to a pressure at least about six times the operating pressure at the top of the higher pressure column (save if desired for any impurities of relatively low volatility such as water vapour and carbon dioxide that are removed at an intermediate pressure).

Preferably, the work for performing a part of the compression of air is obtained from expansion of the compressed air in at least one expansion turbine. By this means, a single independently driven compressor will suffice in meeting; the air compression requirements of the method in conjunction with a plurality of booster turbines each driven by an associated expansion turbine.

BRIEF DESCRIPTION OF THE DRAWING

The method and air separation plant according to the invention will now be described by way of example with reference to the accompanying drawing which is a schematic flow diagram of an air separation plant. The drawing is not to scale.

DETAILED DESCRIPTION

Referring to the drawing, air is compressed in a plural stage compressor 2 to an elevated pressure typically in excess of 35 bar. Each stage (not shown) of the compressor 2 has water cooling associated therewith so as to remove the heat of compression. Downstream of the outlet of the compressor 2, the resulting compressed air stream is passed through a purification unit effective to remove water vapour and carbon dioxide therefrom. Unit 4 employs beds (not shown) of adsorbent to effect this removal of water vapour and carbon dioxide. The beds are operated out of sequence with one another such that while one or more beds are purifying the compressed air stream, the remainder are being regenerated, for example, by being purged with a stream of hot nitrogen. Such purification units and their operation are well known in the art. One advantage of operating the unit 4 at an adsorption pressure in excess of 6 bar is that a considerable reduction in the size and hence capital cost of the adsorption unit can be made in comparison with one operating at a more conventional pressure of about 6 bar. In addition, at higher operating pressures a higher air inlet temperature to the purification unit 4 can be tolerated. If desired, the purification unit 4 may be located intermediate a pair of adjacent stages of the compressor 2.

The compressed, purified air stream is further compressed typically to a pressure in excess of 80 bar in two booster-compressors 6 and 8 in series with one another. Each booster-compressor typically has cooling means (not shown) associated therewith so as to remove the heat of compression. A subsidiary stream of the compressed, purified air is however taken form intermediate the outlet of the booster-compressor 6 and the inlet to the booster-compressor 8 and is passed a part of the way through a main heat exchanger 10 from its warm end 12 to an intermediate region thereof and is withdrawn at a temperature in the order of 160K from said intermediate region. The thus cooled subsidiary air stream is expanded with the performance of external work in a "cold" expansion turbine 16. The external work is the driving of the booster-compressor 6. To this end the booster-compressor 6 and the expansion turbine 16 may have rotors mounted on a common drive shaft 18. The expanded, subsidiary stream of air leaves the expansion turbine 16 at a temperature suitable for its rectification and a pressure a little above the pressure at the bottom of a higher pressure rectification or fractionation column 22 forming part of a double rectification column 20 additionally including a lower pressure rectification column 24. Typically, the expanded subsidiary air stream leaves the expansion turbine 16 with a small proportion of the air in liquid state and at a pressure in the order of 6 bar. The expanded, subsidiary air stream is introduced into the higher pressure column 22 beneath all liquid-vapour contact devices (not shown) therein.

Another air stream for separation in the higher pressure, rectification column 22 is formed by dividing the compressed air stream from the outlet of the booster-compressor 8 and expanding it with the performance of external work in a "warm" expansion turbine 26. The external work in this case is the driving of the booster-compressor 8. To this end the booster-compressor 8 and the expansion turbine 26 may have rotors mounted on a common drive shaft 28. The expanded, subsidiary stream of air leaves the expansion turbine 26 at a temperature in the order of 160K and a pressure a little above that at the bottom of the higher pressure rectification column 22. Since a pressure ratio of more than 13:1 is typically required between the inlet pressure and the outlet pressure of the turbine 26, to employ a single expansion stage in the turbine 26 involves a certain loss of thermodynamic efficiency in comparison with the efficiency levels that can normally be achieved. Accordingly, the turbine 26 preferably comprises two expansion stages in series, that is to say the outlet of the upstream stage communicates with the inlet to the downstream stage. The expanded stream of air leaving the expansion turbine 26 is introduced into the main heat exchanger 10 at essentially the same intermediate temperature region from that at which the subsidiary air stream taken from intermediate the booster-compressors 6 and 8 is withdrawn for expansion in the "cold" turbine 16. The expanded stream of air from the "warm" turbine 26 flows through the main heat exchange 10 in the direction of its cold end 14 and leaves that end of the main heat exchanger 10 at a temperature suitable for its separation by rectification, for example at a temperature in the ore of its dew point or a temperature one or two degrees Kelvin thereabove. This air stream is introduced into the higher pressure rectification column 22 at a level below all liquid-vapour contact devices (not shown) therein.

A third stream of air for separation in the higher pressure rectification column 22 is formed by taking that part of air flow from the outlet of the booster-compressor 8 which does not enter the "warm" expansion turbine 26 and passing it through the main heat exchanger 10 from its warm end 12 to its scold end 14. The thus cooled air stream passes through a throttling or pressure reduction valve 30 (which may simply comprise a length of pipe with a strep therein between an upstream region of narrower cross-section and downstream region of wider cross-section). As a result the air stream undergoes a change in pressure from an upstream pressure at which the air is supercritical fluid to a downstream pressure in which the greater mole fraction of it is in liquid state. The resulting liquid air stream flows from the pressure reduction valve 30 into the higher pressure rectification column 22 at an intermediate mass exchange level thereof.

In the higher pressure rectification column 22 ascending vapour comes into intimate contact with descending liquid and liquid-vapour mass exchange takes place by virtue of the liquid-vapour contact devices (not shown) disposed therein. These devices may take the form of distillation trays or packing. The descending liquid is created by withdrawing vapour (substantially pure nitrogen from the top of the higher pressure rectification column 22), condensing the vapour in the condensing passages of a condenser-reboiler 32 and returning a part of the resulting condensate to the top of the column 22 so that it can flow downwardly therethrough as reflux. The vapour becomes progressively enriched in nitrogen as it ascends the higher pressure rectification column 22.

Liquid is collected at the bottom of the higher pressure rectification column 22. This liquid is approximately in equilibrium with the air that enters the column 22 beneath all the liquid-vapour contact devices therein and is hence somewhat enriched in oxygen. A stream of this oxygen-enriched liquid air is withdrawn from the higher pressure rectification column 22 through an outlet 34 and is sub-cooled by passage through part of a heat exchanger 36. The stream of sub-cooled oxygen-enriched liquid is passed through a throttling valve 38 to reduce its pressure to a little above the operating pressure of the lower pressure column 24. The pressure-reduced stream of sub-cooled oxygen-enriched liquid is divided into two subsidiary streams, of which one is introduced directly into the lower pressure rectification column 24 and of which the other is reboiled by passage through the reboiling passages of a condenser 40 associated with the top of an argon rectification column 42. The reboiled oxygen-enriched liquid air also flows into the lower pressure rectification column 24 at an intermediate mass exchange level thereof below that at which the other oxygen-enriched liquid air stream is introduced.

The oxygen-enriched liquid air introduced into the lower pressure rectification column 24 is separated therein into oxygen and nitrogen. Liquid-vapour contact devices (not shown) are employed in the lower pressure rectification column 24 in order to effect mass exchange between descending liquid and ascending vapour. As a result of this mass exchange the ascending vapour becomes progressively richer in nitrogen and the descending liquid progressively richer in oxygen. The liquid-vapour contact devices (not shown) may take the form of distillation trays or packing. In order to provide liquid nitrogen reflux for the lower pressure rectification column 24, a stream of liquid nitrogen condensate is taken from the condensing passages of the condenser-reboiler 32, is sub-cooled by passage through a part of the heat exchanger 36, is reduced in pressure by passage through a throttling or pressure-reduction valve 44 and is introduced into the top of the column 24.

The boiling passages of the condenser-reboiler 32 reboil liquid oxygen at the bottom of the lower pressure rectification column 24 by indirect heat exchange with condensing nitrogen in the condensing passages. Thus, the upward flow of vapour through the column 24 is provided.

In addition to the oxygen-enriched liquid stream withdrawn from the bottom of the higher pressure rectification column 22, a liquid air stream is withdrawn from approximately the same intermediate mass transfer region of the higher pressure column 22 as that at which the liquid air stream is introduced from the pressure reduction valve 30.

The liquid air stream withdrawn from this intermediate mass transfer region of the higher pressure rectification column 22 is sub-cooled by passage through a part of the heat exchanger 36, is reduced in pressure by passage through a throttling or pressure-reduction valve 46 and is introduced into the lower pressure rectification column at an intermediate mass exchange region thereof above those at which the oxygen-enriched air streams are introduced. The liquid air stream is therefore also separated in the lower pressure rectification column 24.

A stream of oxygen product is withdrawn from the lower pressure rectification column 24 through an outlet 48 and is divided into two subsidiary streams. One subsidiary liquid oxygen stream is taken as liquid oxygen product through a conduit 50 and is typically collected in a thermally-insulated storage vessel (not shown). The other subsidiary liquid oxygen stream is raised in pressure by operation of a pump 52 to a chosen pressure typically in the order of 30 bar. The resulting pressurised oxygen stream is warmed to approximately ambient temperature by passage through the main heat exchanger 10 from its cold end 14 to its warm end 12.

A waste nitrogen stream is withdrawn from a mass exchange level the lower pressure nitrogen rectification column 24 a few theoretical plates below the top thereof. The waste nitrogen stream is warmed by passage through the heat exchanger 36 from its cold end to its warm end and, downstream thereof, by passage through the main heat exchanger 10 from its cold end 14 to its warm end 12.

In order to produce an argon product, a stream of argon-enriched oxygen vapour is withdrawn from the lower pressure rectification column 24 through an outlet 54 situated at a mass exchange level below those at which the streams for separation are introduced and also below the mass exchange level below those all which the streams for separation are introduced and also below the mass exchange level of the column 24 where the argon concentration is a maximum. The argon-enriched oxygen vapour stream, typically containing from 5 to 15% by volume of argon, balance oxygen, is introduced into the bottom region of the argon rectification column 42 through a pressure reduction or throttling valve 56. Liquid-vapour contact devices (not shown) are located in the argon column 42 above the level at which the argon-enriched oxygen vapour is introduced. These contact devices enable mass transfer to take place between an ascending vapour phase and a descending liquid phase. The liquid-vapour contact devices typically take the form of a low pressure drop packing such as the structured packing sold by Sulzer Brothers under the trademark MELLAPAK. Depending on the height of packing within the argon rectification column 42, an argon product typically containing up to 2% by volume may be produced. If sufficient height of packing is employed, the oxygen impurity level in the argon may be reduced to less than 10 volumes per million. An oxygen stream depleted in argon is withdrawn from the bottom of the argon rectification column 42 and is returned through a conduit 58 to an intermediate mass exchange region of the lower pressure rectification column 24. Depending on the height of the bottom of the argon column 42 relative to that of the level of the lower pressure rectification column 24 to which the argon-depleted oxygen stream is returned, a pump 60 may be operated to transfer the argon-depleted liquid oxygen stream.

Reflux for the argon rectification column 42 is provided by condensing argon-rich vapour taken from the top thereof in the condensing passages of the condenser 40 by indirect heat exchange with the oxygen-enriched liquid stream being vaporised in the reboiling passages. A part of the resulting condensate is returned to the top of the column 42 as reflux while the remainder is taken as product liquid argon through a product outlet pipeline 62. The resulting argon product may be stored in a thermally-insulated vessel (not shown). If desired, in an alternative method, a part of the argon-rich vapour may be taken as product and all the condensate from the condenser 40 used as reflux in the argon rectification column 42.

As the liquid make of the method according to the invention increases, so the yield of argon tends to fall. In order to combat this tendency and to enable nitrogen products to be produced, a stream of pure nitrogen vapour is withdrawn from the top of the lower pressure rectification column 24 through an outlet 64. The nitrogen vapour stream flows through the heat exchanger from its cold end to its warm end and downstream thereof through the main heat exchanger 10 from its cold end 14 to its warm end 12. The nitrogen is thus warmed to approximately ambient temperature. The ambient temperature nitrogen stream typically leaves the warm end 12 of the main heat exchanger at a pressure a little above 1.1 bar. The nitrogen is compressed in a plural stage compressor 66, which has water cooling means (not shown) associated with each stage so as to remove the heat of compression, to a pressure well in excess of the critical pressure of nitrogen. If desired, a gaseous nitrogen product at elevated pressure may be withdrawn from an intermediate stage of the compressor 66 through a conduit 68. A stream of nitrogen leaves the final stage of the compressor 66 at a supercritical pressure and is cooled to below its critical temperature by passage through the main heat exchanger 10 from its warm end 12 to its cold end 14. The resulting sub-critical temperature nitrogen stream is passed through a pressure reducing valve 70 and has its pressure reduced to essentially that at the top of the higher pressure rectification column 22. Accordingly, the nitrogen leaves the valve 70 in predominately liquid state. The resulting liquid nitrogen stream is introduced into the top of higher pressure rectification column 22. A stream of liquid nitrogen is withdrawn at an equal rate from the condensed nitrogen formed in the condenser-reboiler 32 and is flashed through a further pressure reducing valve 72 and the resulting vapour-liquid mixture is introduced into a phase separator vessel 74 operating at a pressure a little in excess of 1 bar. The liquid phase disengages from the vapour phase in the vessel 74. The liquid is continuously withdrawn through a conduit 76 to a thermally-insulated storage vessel (not shown) as a liquid nitrogen product. The vapour phase is also continuously withdrawn from the vessel 74 and is mixed with the pure nitrogen vapour stream at a region thereof intermediate the heat exchangers 36 and 10. A liquid nitrogen product is thus able to be produced without loss of argon yield.

In a typical example of operation of the plant shown in the accompanying drawing; the compressor 2 has an outlet pressure of 38 bar, the booster-compressor 6 an outlet pressure of 46 bar, and the booster-compressor 8 an outlet pressure of 82 bar. In this example, the operating pressure at the bottom of the higher pressure column 22 is approximately 6 bar, that at the bottom of the lower pressure rectification column 24 approximately 1.5 bar and that at the bottom of the argon rectification column 42 approximately 1.25 bar. Accordingly, the two expansion turbines 16 and 26 both have outlet pressures a little above 6 bar. Further, in this example the outlet pressure of the nitrogen compressor is 72 bar. Under these operating conditions an argon yield of approximately 98% can be obtained when the liquid make is approximately 67%.

We claim:

1. A method of separating air comprising:

compressing and purifying the air;

fractionating a first stream of the compressed purified air in a higher pressure column of a double rectification column comprising said higher pressure column and a lower pressure column;

condensing, by indirect heat exchange with oxygen-rich fluid separated in the lower pressure column, nitrogen vapour separated in the higher pressure column and employing a first stream of the resulting condensate as reflux in the higher pressure column and a second stream of the resulting condensate as reflux in the lower pressure rectification column;

withdrawing a proportion of oxygen-and/or nitrogen-rich products from the double rectification column in liquid state;

separating in an argon column a stream of argon-enriched fluid withdrawn from the lower pressure column so as to obtain argon-rich vapour;

condensing at least some of the said argon-rich vapour and employing at least some of the resulting argon-rich condensate in the argon column as reflux;

withdrawing an argon-rich product stream from the argon column; and forming liquid nitrogen by warming in indirect heat exchange, a stream of nitrogen withdrawn from the double rectification column, compressing said warmed stream of nitrogen, cooling by indirect heat exchange the compressed stream of nitrogen, and reducing the pressure of the cooled, compressed stream of nitrogen.

2. The method as claimed in claim 1, in which the ratio of the rate of production of liquid products to the rate of production of oxygen (including liquid oxygen) is in a range of about 30% and about 70%.

3. The method as claimed in claim 1, in which all the air to be separated is compressed to a pressure at least about six times the operating pressure at the top of the higher pressure column.

4. The method as claimed in claim 3, in which water vapour and carbon dioxide are removed from the air at an intermediate pressure.

5. The method as claimed in claim 1, in which the work for performing a part of the compression of the air is obtained from expansion of the compressed air in at least one expansion turbine.

6. An air separation plant comprising:

a double rectification column comprising a higher pressure column for separating nitrogen from a first stream of compressed, purified air, and a lower pressure column;

a condenser-reboiler for condensing by indirect heat exchange with oxygen-rich fluid separated in the lower pressure column, nitrogen vapour separated in the higher pressure column, said condenser-reboiler having condensing passages with outlets communicating with both the higher pressure and lower pressure columns so as to enable liquid nitrogen reflux to be supplied in use to both the higher and lower pressure columns;

product outlets from the double rectification column for oxygen-rich and nitrogen-rich products, said product outlets arranged such that a proportion of said products are able to be taken in liquid state;

an argon outlet from the lower pressure rectification column for argon-enriched oxygen communicating with an argon column for separating argon-rich vapour therefrom;

a condenser associated with the argon column for condensing at least some of the said argon-rich vapour and for returning some of the resulting argon-rich condensate to the argon column;

an argon-rich vapour outlet from the argon column for argon-rich vapour; and means for producing liquid nitrogen, comprising a heat exchanger for warming a stream of nitrogen withdrawn from the double rectification column, a compressor for compressing the warmed nitrogen stream, a heat exchanger for cooling the stream of compressed nitrogen, and means for reducing the pressure of the cooled, compressed stream of nitrogen.

7. The apparatus as claimed in claim 6, additionally including a plurality of compressors for compressing the air.

8. The apparatus as claimed in claim 7, in which there is a single independently driven, plural stage, compressor upstream of two booster-compressors in series, both booster-compressors each being drivable by an expansion turbine for expanding the compressed air with the performance of external work.

9. The apparatus as claimed in claim 8, including a unit for purifying the air intermediate a pair of stages of the independently driven compressor or intermediate the outlet of the independently driven compressor and the inlet to the upstream booster-compressor.

* * * * *